US008796192B2

(12) United States Patent
Tobias et al.

(10) Patent No.: US 8,796,192 B2
(45) **Date of Patent: *Aug. 5, 2014**

(54) NATURAL GAS ENGINE LUBRICATING OIL COMPOSITIONS

(75) Inventors: Melanie F. Tobias, Pleasant Hill, CA (US); Jon F. Von Staden, San Antonio, TX (US)

(73) Assignee: Chevron Oronite Company LLC, San Ramon, CA (US)

( * ) Notice: Subject to any disclaimer, the term of this patent is extended or adjusted under 35 U.S.C. 154(b) by 348 days.

This patent is subject to a terminal disclaimer.

(21) Appl. No.: 12/925,799

(22) Filed: Oct. 29, 2010

(65) Prior Publication Data

US 2012/0108477 A1 May 3, 2012

(51) Int. Cl.

| | |
|---|---|
| ***C10M 169/04*** | (2006.01) |
| ***C07C 309/63*** | (2006.01) |
| ***C10M 129/76*** | (2006.01) |
| ***C09K 15/08*** | (2006.01) |
| ***C10M 137/10*** | (2006.01) |
| ***C10M 141/10*** | (2006.01) |
| ***C10M 163/00*** | (2006.01) |

(52) U.S. Cl.

CPC ..... *C10M 163/00* (2013.01); *C10N 2230/52* (2013.01); *C10M 2219/044* (2013.01); *C10M 2207/262* (2013.01); *C10N 2210/01* (2013.01); *C10M 2207/026* (2013.01); *C10M 2223/04* (2013.01); *C10N 2210/02* (2013.01); *C10M 2207/027* (2013.01); *C10M 2223/049* (2013.01); *C10M 2207/144* (2013.01); *C10M 2223/045* (2013.01); *C10N 2230/40* (2013.01); *C10M 2219/022* (2013.01); *C10M 2207/028* (2013.01); *C10M 2219/046* (2013.01); *C10M 2215/28* (2013.01); *C10N 2240/10* (2013.01); *C10N 2230/06* (2013.01); *C10M 2203/1025* (2013.01); *C10N 2230/45* (2013.01); *C10M 2223/00* (2013.01); *C10N 2230/42* (2013.01)

USPC ..... 508/287; 508/110; 508/390; 508/502; 508/584; 508/370; 508/291; 508/421

(58) Field of Classification Search

USPC ..... 508/287, 110, 390, 502, 584, 370, 291, 508/421

See application file for complete search history.

(56) References Cited

U.S. PATENT DOCUMENTS

| | | | |
|---|---|---|---|
| 2,202,781 | A | 5/1939 | Kennedy |
| 2,212,786 | A | 5/1939 | McQueen |

(Continued)

FOREIGN PATENT DOCUMENTS

| | | |
|---|---|---|
| EP | 0351906 | 9/1992 |
| EP | 0927754 | 7/1999 |

(Continued)

OTHER PUBLICATIONS

PCT International Search Report, PCT/US2011/056197, filed Oct. 13, 2011, Mail Date: May 31, 2012.

(Continued)

*Primary Examiner* — Vishal Vasisth

(57) ABSTRACT

A natural gas engine lubricating oil composition is disclosed which comprises (a) a major amount of an oil of lubricating viscosity, (b) one or more phosphorus-containing anti-wear additives, (c) one or more oil soluble overbased alkaline earth metal-containing detergents; and (d) one or more oil soluble neutral alkali metal-containing detergents, wherein the natural gas engine lubricating oil composition contains no more than about 0.03 weight percent of phosphorus, based on the total weight of the natural gas engine lubricating oil composition.

16 Claims, 1 Drawing Sheet

(56) References Cited

U.S. PATENT DOCUMENTS

| | | | |
|---|---|---|---|
| 2,174,110 | A | 9/1939 | Reed |
| 2,174,506 | A | 9/1939 | Fox |
| 2,174,508 | A | 9/1939 | Fox |
| 2,193,824 | A | 3/1940 | Lockwood et al. |
| 2,197,800 | A | 4/1940 | Henke et al. |
| 2,197,832 | A | 4/1940 | Reiff |
| 2,197,835 | A | 4/1940 | Reiff |
| 2,213,360 | A | 9/1940 | Calcott et al. |
| 2,223,676 | A | 12/1940 | Dinsmure et al. |
| 2,228,598 | A | 1/1941 | Fox et al. |
| 2,239,974 | A | 4/1941 | Reed et al. |
| 2,252,662 | A | 8/1941 | Reiff |
| 2,252,664 | A | 8/1941 | Reiff |
| 2,276,090 | A | 3/1942 | Reed |
| 2,276,097 | A | 3/1942 | Salzberg |
| 2,315,514 | A | 4/1943 | Fox |
| 2,319,121 | A | 5/1943 | Fox |
| 2,321,022 | A | 6/1943 | Fox |
| 2,333,568 | A | 11/1943 | Henke et al. |
| 2,333,788 | A | 11/1943 | Holbrook et al. |
| 2,335,259 | A | 11/1943 | Calcott |
| 2,337,552 | A | 12/1943 | Henke |
| 2,347,568 | A | 4/1944 | Kunert |
| 2,366,027 | A | 12/1944 | Henke |
| 2,374,193 | A | 4/1945 | Grubb |
| 2,383,319 | A | 8/1945 | Kharasch |
| 2,501,731 | A | 3/1950 | Mertes |
| 2,616,904 | A | 11/1952 | Asseff et al. |
| 2,616,905 | A | 11/1952 | Asseff et al. |
| 2,616,906 | A | 11/1952 | Asseff et al. |
| 2,616,911 | A | 11/1952 | Asseff |
| 2,616,924 | A | 11/1952 | Asseff et al. |
| 2,616,925 | A | 11/1952 | Asseff et al. |
| 2,617,049 | A | 11/1952 | Asseff et al. |
| 2,680,096 | A | 6/1954 | Walker et al. |
| 2,714,092 | A | 7/1955 | Colnane et al. |
| 2,777,874 | A | 1/1957 | Asseff et al. |
| 3,027,325 | A | 3/1962 | McMillen et al. |
| 3,036,003 | A | 5/1962 | Verdol |
| 3,036,971 | A | 5/1962 | Otto |
| 3,172,892 | A | 3/1965 | Le Suer et al. |
| 3,219,666 | A | 11/1965 | Norman et al. |
| 3,256,186 | A | 6/1966 | Greenwald |
| 3,271,130 | A | 9/1966 | Denig |
| 3,272,746 | A | 9/1966 | Le Suer et al. |
| 3,272,764 | A | 9/1966 | Mueller et al. |
| 3,275,554 | A | 9/1966 | Wagenaar |
| 3,282,835 | A | 11/1966 | Asseff |
| 3,312,618 | A | 4/1967 | Le Suer et al. |
| 3,318,809 | A | 5/1967 | Bray |
| 3,320,162 | A | 5/1967 | Axe et al. |
| 3,329,658 | A | 7/1967 | Fields |
| 3,342,733 | A | 9/1967 | Robbins et al. |
| 3,350,038 | A | 10/1967 | Oberlander |
| 3,368,396 | A | 2/1968 | Burkleo et al. |
| 3,373,108 | A | 3/1968 | Woodle et al. |
| 3,384,585 | A | 5/1968 | Gragson et al. |
| 3,410,798 | A | 11/1968 | Cohen |
| 3,438,757 | A | 4/1969 | Honnen et al. |
| 3,449,250 | A | 6/1969 | Fields |
| 3,454,555 | A | 7/1969 | Vander Voort |
| 3,471,403 | A | 10/1969 | Le Suer et al. |
| 3,488,284 | A | 1/1970 | Le Suer et al. |
| 3,510,428 | A | 5/1970 | Didden et al. |
| 3,523,082 | A | 8/1970 | Vienna et al. |
| 3,565,804 | A | 2/1971 | Honnen et al. |
| 3,567,637 | A | 3/1971 | Nishijima et al. |
| 3,586,629 | A | 6/1971 | Otto et al. |
| 3,591,598 | A | 7/1971 | Traise et al. |
| 3,595,790 | A | 7/1971 | Norman |
| 3,595,791 | A | 7/1971 | Cohen |
| 3,629,109 | A | 12/1971 | Gergel et al. |
| 3,632,610 | A | 1/1972 | Schmitz |
| 3,646,730 | A | 3/1972 | Reid |
| 3,666,730 | A | 5/1972 | Coleman |
| 3,666,732 | A | 5/1972 | Skouitchi et al. |
| 3,775,321 | A | 11/1973 | Turnquest et al. |
| 3,798,012 | A | 3/1974 | Le Suer |
| 3,798,163 | A | 3/1974 | Palmer |
| 3,850,822 | A | 11/1974 | Steere et al. |
| 3,980,569 | A | 9/1976 | Pindar et al. |
| 4,234,435 | A | 11/1980 | Meinhardt et al. |
| 4,612,132 | A | 9/1986 | Wollenberg et al. |
| 4,746,446 | A | 5/1988 | Wollenberg et al. |
| 4,849,118 | A | 7/1989 | Stauffer et al. |
| 5,595,964 | A | 1/1997 | Bardasz |
| 5,716,912 | A | 2/1998 | Harrison et al. |
| 5,726,133 | A | 3/1998 | Blahey et al. |
| 6,001,780 | A | 12/1999 | Ho et al. |
| 6,135,565 | A | 10/2000 | Bachelor |
| 6,140,282 | A * | 10/2000 | Cartwright et al. ..... 508/398 |
| 6,147,035 | A | 11/2000 | Saugaula et al. |
| 6,165,235 | A | 12/2000 | Kolp et al. |
| 6,174,842 | B1 | 1/2001 | Gatto et al. |
| 6,281,179 | B1 | 8/2001 | Skinner et al. |
| 2,263,312 | A1 | 11/2001 | Reed |
| 6,372,696 | B1 | 4/2002 | Tipton |
| 6,429,178 | B1 | 8/2002 | Skinner et al. |
| 6,429,179 | B1 | 8/2002 | Skinner et al. |
| 6,440,905 | B1 | 8/2002 | Epps et al. |
| 6,596,672 | B1 | 7/2003 | Carrick et al. |
| 6,642,191 | B2 | 11/2003 | Palazzotto et al. |
| 6,727,208 | B2 | 4/2004 | Wilk |
| 6,756,348 | B2 | 6/2004 | Palazzotto et al. |
| 7,309,681 | B2 | 12/2007 | Cartwright |
| 2004/0142827 | A1 | 7/2004 | Palazzotto et al. |
| 2005/0026792 | A1 | 2/2005 | Cartwright |
| 2005/0070447 | A1 | 3/2005 | Barnes et al. |
| 2005/0137098 | A1 | 6/2005 | Le Cuent et al. |
| 2006/0009366 | A1 | 1/2006 | Sant et al. |
| 2007/0027043 | A1 | 2/2007 | Le Cuent |
| 2007/0066495 | A1 | 3/2007 | Macpherson |
| 2007/0129263 | A1 | 6/2007 | Boffa et al. |
| 2007/0142239 | A1 | 6/2007 | Boffa et al. |
| 2007/0149419 | A1 | 6/2007 | Irving et al. |
| 2008/0153722 | A1 | 6/2008 | Van Leeuwen et al. |
| 2010/0210493 | A1 | 8/2010 | Tobias et al. |

FOREIGN PATENT DOCUMENTS

| | | |
|---|---|---|
| GB | 1368277 | 9/1974 |
| JP | 2927530 | 7/1999 |
| JP | 2004/107556 | 4/2004 |
| JP | 2005/162968 | 6/2005 |
| WO | WO 2010/009036 | 1/2010 |

OTHER PUBLICATIONS

Wim van Dam, et al. "A New CNG Engine Test for the Evaluation of Natural Gas Engine Oils", International Spring Fuels and Lubricants Meeting and Exposition, Dearborn, Michigan, May 4-6, 1998, pp. 1-11.

Pyle et al. "The Effect of Lubricating Oil Additives on Valve Recession in Stationary Gaseous-Fueled Four-Cycle Engines", Fuel and Lubricants Meeting and Exposition, Philadelphia, PA, Oct. 18-21, 1993, pp. 89-110.

O'Connor S et al: "Overbased Lubricant Detergents—a Comparitive Study",Lubrication Science, Leaf Coppin Publishing Ltd, US, vol. 6, No. 4, Jan. 1, 1994, pp. 297-325, XP007909653.

* cited by examiner

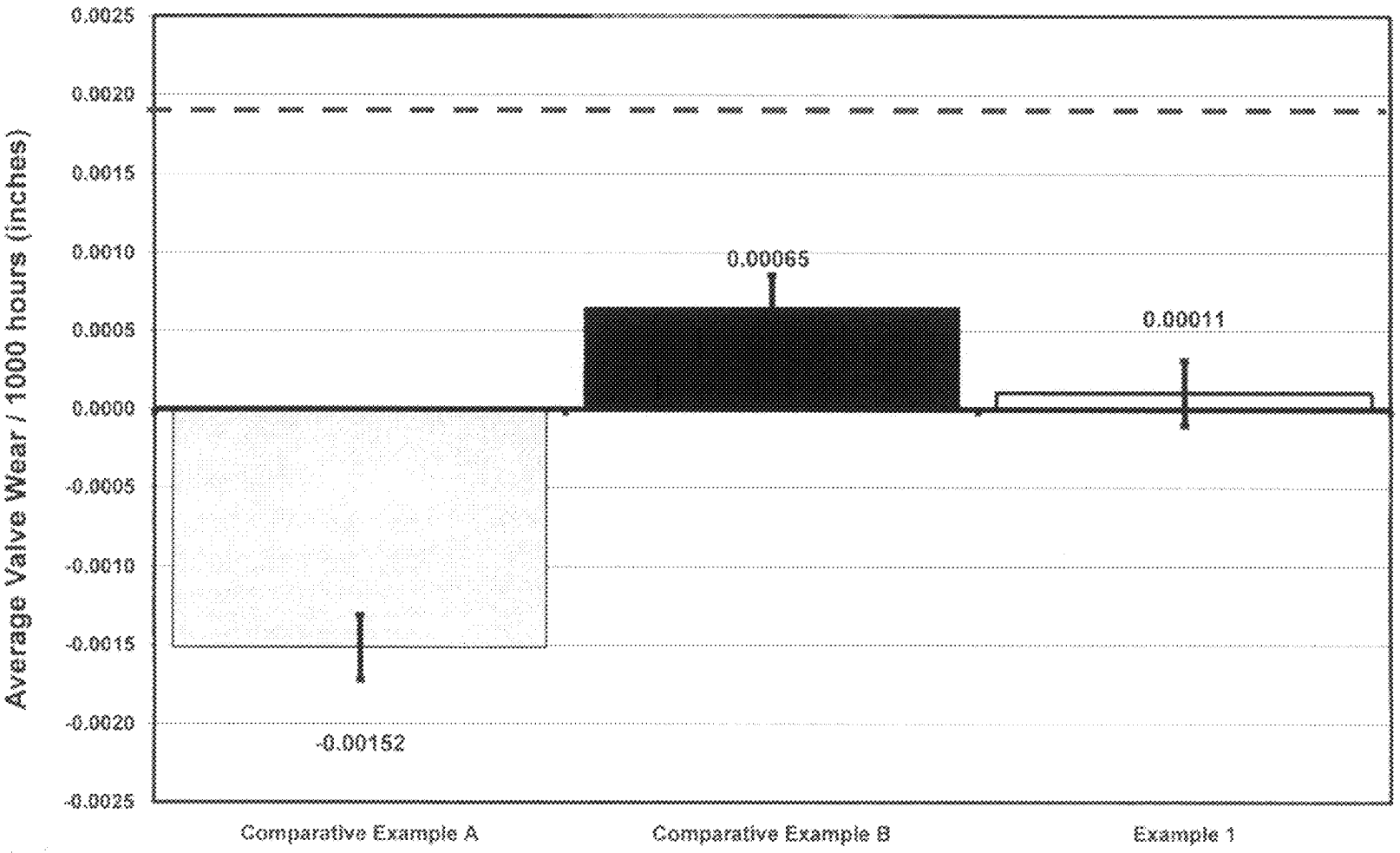
0.0025
0.0020
0.0015
0.0010
0.0005
0.0000
-0.0005
-0.0010
-0.0015
-0.0020
-0.0025
Average Valve Wear / 1000 hours (inches)
0.00065
0.00011
-0.00152
Comparative Example A
Comparative Example B
Example 1

NATURAL GAS ENGINE LUBRICATING OIL COMPOSITIONS

BACKGROUND OF THE INVENTION

1. Technical Field

The present invention generally relates to a natural gas engine lubricating oil composition and a method for preventing or inhibiting exhaust valve seat recession in natural gas fueled internal combustion engines.

2. Description of the Related Art

Natural gas fueled engines are engines that use natural gas as a fuel source. Lubricating oils with high resistance to oxidation, nitration and viscosity increase are generally preferred for lubricating oils used in natural gas engines because of the conditions related to this type of engine.

Natural gas has a higher specific heat content than liquid hydrocarbon fuels and therefore it will burn hotter than liquid hydrocarbon fuels under typical conditions. In addition, since it is already a gas, natural gas does not cool the intake air by evaporation as compared to liquid hydrocarbon fuel droplets. Furthermore, many natural gas fueled engines are run either at or near stoichiometric conditions, where less excess air is available to dilute and cool combustion gases. As a result, natural gas fueled engines generate higher combustion gas temperatures than engines burning liquid hydrocarbon fuels. In most cases, natural gas fueled engines are used continuously at 70 to 100% load, whereas an engine operating in vehicular service may only spend 50% of its time at full load.

This condition of running continuously near full load places severe demands on the lubricant. For example, by subjecting the lubricating oil to a sustained high temperature environment, the life of the lubricant is often limited by oil oxidation processes. Also, since the rate of formation of oxides of nitrogen (NOx), increases exponentially with temperature, natural gas fueled engines may generate $NO_x$ concentrations high enough to cause severe nitration of lubricating oil.

Good valve wear control is also important for keeping engine operating costs down and may be achieved by providing the proper amount and composition of ash. In addition, minimizing combustion chamber deposits and spark plug fouling are considerations in setting the ash content in these oils. Lubricating oil ash levels are limited, so detergents must be carefully selected to minimize piston deposits and ring sticking.

Valve wear resistance is important to the durability of natural gas fueled engines. In general, exhaust valve recession is wear which occurs at the valve and valve seat interface and is the most pronounced form of valve wear in natural gas fueled engines. When the valve is prevented from seating properly, it can cause engine roughness, poor fuel economy and excessive emissions. In order to correct excessive valve wear, a cylinder head overhaul is usually required. Although natural gas fueled engines typically use very hard corrosion-resistant material for the valve face and seat mating surface to give extended cylinder head life, it does not completely eliminate valve recession.

There is a difference in the lubricating oil requirements for natural gas fueled engines and engines that are fueled by liquid hydrocarbon fuels. The combustion of liquid hydrocarbon fuels such as diesel fuel often results in a small amount of incomplete combustion (e.g., exhaust particulates). In a liquid hydrocarbon fueled engine, these incombustibles provide a small but critical degree of lubrication to the exhaust valve/seat interface, thereby ensuring the durability of both cylinder heads and valves.

Natural gas fueled engines burn fuel that is introduced to the combustion chamber in the gaseous phase. The combustion of natural gas fuel is often very complete, with virtually no incombustible materials. This has a significant affect on the intake and exhaust valves because there is no fuel-derived lubricant such as liquid droplets or soot to aid in lubrication to the exhaust valve/seat interface in a natural gas fueled engine. Therefore, the durability of the cylinder head and valve is controlled by the ash content and other properties of the lubricating oil and its consumption rate to provide lubricant between the hot valve face and its mating seat. Too little ash or the wrong type can accelerate valve and seat wear, while too much ash may lead to valve guttering and subsequent valve torching. Too much ash can also lead to loss of compression or detonation from combustion chamber deposits. Consequently, gas engine builders frequently specify a narrow ash range that they have learned provides the optimum performance. Since most gas is low in sulfur, excess ash is generally not needed to address alkalinity requirements, and ash levels are largely optimized around the needs of the valves. There may be exceptions to this in cases where sour gas or landfill gas is used. The use of catalysts is becoming more prevalent as a means to meet stricter emission regulations. Limiting phosphorous content in the lubricating oil can prevent catalyst poisoning.

U.S. Pat. No. 3,798,163 ("the '163 patent") discloses a method for controlling or inhibiting exhaust valve recession in natural gas fueled internal combustion engines by maintaining a lubricating amount of a lubricating oil composition on the engine components of the internal combustion engine. The '163 patent further discloses that the lubricating oil composition contains (a) a major amount of an oil of lubricating viscosity, (b) at least one alkaline earth metal sulfonate in an amount sufficient to improve the detergency of the composition, and (c) at least one alkaline earth metal salt of a condensation product of (i) an alkylene polyamine, (ii) an aldehyde, and (iii) a substituted phenol, wherein the alkaline earth metal salt of the condensation product is present in an amount sufficient to inhibit the recession of the engine's exhaust valves into the engine cylinder head.

U.S. Pat. No. 5,726,133 ("the '133 patent") discloses a low ash gas engine oil comprising a major amount of a base oil of lubricating viscosity and a minor amount sufficient to contribute a sulfated ash content of about 0.1 to 0.6% ash by ASTM D 874 of an additive mixture comprising a mixture of detergents comprising at least one first alkali or alkaline earth metal salt or mixture thereof of low Total Base Number (TBN) of about 250 and less and at least one second alkali or alkaline earth metal salt or mixture thereof having a TBN lower than the first detergent. The '133 patent further discloses that the second alkali or alkaline earth metal salt or mixture thereof will have a TBN about half or less of the first detergent. The '133 patent also discloses that the fully formulated gas engine oil can also typically contain other standard additives known to those skilled in the art, including anti-wear additives such as zinc dithiophosphates, dispersants, phenolic or aminic antioxidants, metal deactivators, pour point depressants, antifoaming agents, and viscosity index improvers.

U.S. Pat. No. 6,596,672 ("the '672 patent") discloses a low ash lubricant composition containing (a) a major amount of lubricating oil, (b) a calcium, barium, or strontium overbased acidic material in an amount to contribute 0.01 to 0.79 percent sulfated ash; (c) a magnesium or sodium overbased acidic material in an amount to contribute 0.01 to 0.79 percent sulfated ash; (d) about 0.1 to about 1.5 percent by weight of an alkylene-coupled hindered phenol antioxidant; (e) about 0.1 to about 6 percent by weight of at least one aromatic amine antioxidant; provided that components (d) and (e) together comprise at least about 0.5 percent by weight of the composition; and (f) at least about 0.2 percent by weight of a dispersant. The '672 patent further discloses that the composition has a total sulfated ash content of about 0.1 percent to about 0.8 percent.

U.S. Patent Application Publication No. 20070129263 ("the '263 application") discloses a lubricating oil composition containing (a) a major amount of an oil of lubricating viscosity; (b) one or more lithium-containing detergents; (c) one or more detergents other than a lithium-containing detergent; (d) one or more antioxidants; (e) one or more dispersants; and (f) one or more anti-wear agents, wherein the lubricating oil composition contains no more than 0.1 weight percent of lithium-containing detergents and no more than 0.12 weight percent phosphorus, and provided the lubricating oil composition does not contain a calcium-containing detergent. The detergents other than a lithium-containing detergent disclosed in the '263 application include low and medium overbased metal detergents such as low and medium overbased phenates, sulfurized phenates, aromatic sulfonates, salicylates, sulfurized salicylates or Mannich condensation products of alkylphenols, aldehydes and amines. The '263 application further discloses that the lubricating oil composition is useful for reducing catalyst poisoning in exhaust after treatment in internal combustion engines such as diesel engines, gasoline engines and natural gas engines.

WO 2010/009036 discloses a lubricating oil composition containing one or more overbased alkaline earth metal detergents and one or more overbased alkali metal detergents.

It is desirable to develop improved natural gas engine lubricating oil compositions which can prevent or inhibit exhaust valve recession in natural gas fueled internal combustion engines.

SUMMARY OF THE INVENTION

In accordance with one embodiment of the present invention, a natural gas engine lubricating oil composition is provided comprising (a) a major amount of an oil of lubricating viscosity, (b) one or more phosphorus-containing anti-wear additives, (c) one or more oil soluble overbased alkaline earth metal-containing detergents; and (d) one or more oil soluble neutral alkali metal-containing detergents, wherein the natural gas engine lubricating oil composition contains no more than about 0.03 weight percent of phosphorus, based on the total weight of the natural gas engine lubricating oil composition.

In accordance with a second embodiment of the present invention, a natural gas engine lubricating oil composition is provided comprising (a) a major amount of an oil of lubricating viscosity, (b) one or more phosphorus-containing anti-wear additives, (c) one or more oil soluble overbased alkaline earth metal-containing detergents; (d) one or more oil soluble neutral alkali metal-containing detergents; (e) one or more ashless dispersants, and (f) one or more antioxidants, wherein the natural gas engine lubricating oil composition contains no more than about 0.03 weight percent of phosphorus, based on the total weight of the natural gas engine lubricating oil composition.

In accordance with a third embodiment of the present invention, there is provided a method for preventing or inhibiting exhaust valve seat recession in a natural gas fueled engine, the method comprising lubricating the engine with a natural gas engine lubricating oil composition comprising (a) a major amount of an oil of lubricating viscosity, (b) one or more phosphorus-containing anti-wear additives, (c) one or more oil soluble overbased alkaline earth metal-containing detergents; and (d) one or more oil soluble neutral alkali metal-containing detergents, wherein the natural gas engine lubricating oil composition contains no more than about 0.03 weight percent of phosphorus, based on the total weight of the natural gas engine lubricating oil composition.

In accordance with a fourth embodiment of the present invention, there is provided a method for enhancing the life of an exhaust valve in a natural gas fueled engine as evidenced by protection or inhibition in exhaust valve seat recession in the natural gas fueled engine, the method comprising lubricating the natural gas fueled engine with a natural gas engine lubricating oil composition comprising (a) a major amount of an oil of lubricating viscosity, (b) one or more phosphorus-containing anti-wear additives, (c) one or more oil soluble overbased alkaline earth metal-containing detergents; and (d) one or more oil soluble neutral alkali metal-containing detergents, wherein the natural gas engine lubricating oil composition contains no more than about 0.03 weight percent of phosphorus, based on the total weight of the natural gas engine lubricating oil composition.

In accordance with a fifth embodiment of the present invention, the use of a natural gas engine lubricating oil composition comprising (a) a major amount of an oil of lubricating viscosity, (b) one or more phosphorus-containing anti-wear additives, (c) one or more oil soluble overbased alkaline earth metal-containing detergents; and (d) one or more oil soluble neutral alkali metal-containing detergents, wherein the natural gas engine lubricating oil composition contains no more than about 0.03 weight percent of phosphorus, based on the total weight of the natural gas engine lubricating oil composition, for the purpose of preventing or inhibiting exhaust valve seat recession in a natural gas fueled engine is provided.

By lubricating a natural gas fueled internal combustion engine with a natural gas engine lubricating oil composition comprising (a) a major amount of an oil of lubricating viscosity, (b) one or more phosphorus-containing anti-wear additives, (c) one or more oil soluble overbased alkaline earth metal-containing detergents; and (d) one or more oil soluble neutral alkali metal-containing detergents, wherein the natural gas engine lubricating oil composition contains no more than about 0.03 weight percent of phosphorus, based on the total weight of the natural gas engine lubricating oil composition, exhaust valve seat recession in the natural gas fueled engine is prevented or inhibited.

BRIEF DESCRIPTION OF THE DRAWING

FIG. 1 is a bar graph comparing the exhaust valve recession wear rates for the natural gas engine lubricating oil composition of Example 1 versus the natural gas engine lubricating oil compositions of Comparative Examples A and B.

DETAILED DESCRIPTION OF THE PREFERRED EMBODIMENTS

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

The term "alkali metal" as used herein refers to Group 1 metals of the Periodic Table.

The term "alkaline earth metal" as used herein refers to Group 2 metals of the Periodic Table.

The term "carboxylate" means an alkaline earth metal salt of an alkyl-substituted hydroxyaromatic carboxylic acid.

The term "phenate" means a salt of a phenol.

The term "Base Number" or "BN" as used herein refers to the amount of base equivalent to milligrams of KOH in one gram of sample. Thus, higher BN numbers reflect more alkaline products, and therefore a greater alkalinity. BN was determined using ASTM D 2896 test.

The present invention is directed to a natural gas engine lubricating oil composition containing (a) a major amount of an oil of lubricating viscosity, (b) one or more phosphorus-containing anti-wear additives, (c) one or more oil soluble overbased alkaline earth metal-containing detergents; and (d) one or more oil soluble neutral alkali metal-containing detergents, wherein the natural gas engine lubricating oil composition contains no more than about 0.03 weight percent of phosphorus, based on the total weight of the natural gas engine lubricating oil composition.

In one embodiment, the natural gas engine lubricating oil compositions according to the present invention contain from about 0.005 to about 0.03 wt. % of phosphorus, based on the total weight of the natural gas engine lubricating oil composition.

In one embodiment, a natural gas engine lubricating oil composition according to the present invention will have a sulfated ash content of no more than about 1.25 wt. % as determined by ASTM D 874. In another embodiment, a natural gas engine lubricating oil composition according to the present invention will have a sulfated ash content of no more than about 1 wt. % as determined by ASTM D 874. In another embodiment, a natural gas engine lubricating oil composition according to the present invention will have a sulfated ash content of no more than about 0.3 wt. % as determined by ASTM D 874. In one embodiment, a natural gas engine lubricating oil composition according to the present invention for use in natural gas fueled engines has a sulfated ash content of about 0.1 wt. % to about 1.25 wt. % as determined by ASTM D 874. In another embodiment, a natural gas engine lubricating oil composition according to the present invention will have a sulfated ash content of about 0.12 wt. % to about 1.0 wt. % as determined by ASTM D 874. In another embodiment, a natural gas engine lubricating oil composition according to the present invention will have a sulfated ash content of about 0.15 wt. % to about 0.3 wt. % as determined by ASTM D 874. The lubricant ash advantageously acts as a solid film lubricant to protect the valve/seat interface in place of naturally occurring exhaust particles in a hydrocarbon fueled engine.

In another embodiment, a natural gas engine lubricating oil composition according to the present invention contains relatively low levels of sulfur, i.e., not exceeding 0.4 wt. %, based on the total weight of the natural gas engine lubricating oil composition.

The internal combustion engines to which the present invention is applicable may be characterized as those operated on, i.e., fueled by, natural gas and include internal combustion engines. Examples of such engines include four cycle engines and the like. In one preferred embodiment, the internal combustion engine is a stationary engine used in, for example, well-head gas gathering, compression, and other gas pipeline services; electrical power generation (including co-generation); and irrigation.

The oil of lubricating viscosity for use in a natural gas engine lubricating oil compositions of this invention, also referred to as a base oil, is typically present in a major amount, e.g., an amount greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used herein will have a kinematic viscosity range at 100° C. of about 2 cSt to about 30 cSt. In one embodiment, the base oils used herein will have a kinematic viscosity range at 100° C. of about 5 cSt to about 20 cSt. In one embodiment, the base oils used herein will have a kinematic viscosity range at 100° C. of about 7 cSt to about 15 cSt. The base oil will be selected or blended depending on the desired end use and the additives in the finished oil to give the desired grade of oil, e.g., a lubricating oil composition having an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

Base stocks may be manufactured using a variety of different processes including, but not limited to, distillation, solvent refining, hydrogen processing, oligomerization, esterification, and rerefining. Rerefined stock shall be substantially free from materials introduced through manufacturing, contamination, or previous use. The base oil of the lubricating oil compositions of this invention may be any natural or synthetic lubricating base oil. Suitable hydrocarbon synthetic oils include, but are not limited to, oils prepared from the polymerization of ethylene or from the polymerization of 1-olefins to provide polymers such as polyalphaolefin or PAO oils, or from hydrocarbon synthesis procedures using carbon monoxide and hydrogen gases such as in a Fischer-Tropsch process. For example, a suitable base oil is one that comprises little, if any, heavy fraction; e.g., little, if any, lube oil fraction of viscosity 20 cSt or higher at 100° C.

The base oil may be derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude. Suitable base oils include those in all API categories I, II, III, IV and V as defined in API Publication 1509, 16$^{th}$ Edition, Addendum I, October, 2009. Group IV base oils are polyalphaolefins (PAO). Group V base oils include all other base oils not included in Group I, II, III, or IV. Although Group II, III and IV base oils are preferred for use in this invention, these base oils may be prepared by combining one or more of Group I, II, III, IV and V base stocks or base oils.

Useful natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Useful synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other useful synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional useful synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of useful synthetic lubricating oils includes, but is not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500 to 1000, diethyl ether of polypropylene glycol having a molecular weight of 1,000 to 1,500, etc.) or mono- and polycarboxylic esters thereof such as, for example, the acetic esters, mixed $C_3$ to $C_8$ fatty acid esters, or the $C_{13}$ oxo acid diester of tetraethylene glycol.

Yet another class of useful synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The lubricating oil may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process. Examples of useful oils of lubricating viscosity include HVI and XHVI basestocks, such isomerized wax base oils and UCBO (Unconventional Base Oils) base oils.

The natural gas engine lubricating oil compositions of the present invention will also contain one or more phosphorus-containing anti-wear additives, wherein the natural gas engine lubricating oil composition contains no more than about 0.03 weight percent of phosphorus, based on the total weight of the natural gas engine lubricating oil composition. Suitable phosphorus-containing anti-wear additives include, but are not limited to, hydrocarbyl phosphites such as trialkyl phosphites aryl-containing phosphites, e.g., triaryl phosphites, and the like; hydrocarbyl phosphates such as trialkyl phosphates, aryl-containing phosphates, e.g., triaryl phosphates, alkyl diaryl phosphates and the like and mixtures thereof. In one embodiment, at least two phosphorus-containing anti-wear additives are used in the natural gas engine lubricating oil composition.

Representative examples of trialkyl phosphites include, but are not limited to, tributyl phosphite, trihexyl phosphite, trioctyl phosphite, tridecyl phosphite, trilauryl phosphite, trioleyl phosphite and the like. Representative examples of aryl-containing phosphites include triaryl phosphites such as triphenyl phosphite, tricresylphosphite and the like.

Representative examples of trialkyl phosphates include, but are not limited to, tributyl phosphate, trihexyl phosphate, trioctyl phosphate, tridecyl phosphate, trilauryl phosphate, trioleyl phosphate and the like. Representative examples of aryl-containing phosphates include, but are not limited to, butyl diphenyl phosphate, dibutyl phenyl phosphate, t-butylphenyl diphenyl phosphate, bis(t-butylphenyl)phenyl phosphate, tri(t-butylphenyl) phosphate, triphenyl phosphate, and propylated triphenyl phosphate, and the like and mixtures thereof.

In one embodiment, the one or more phosphorus-containing anti-wear additives include a zinc dialkyldithiophosphate (Zn-DTP, primary alkyl type and secondary alkyl type).

In general, the one or more phosphorus-containing anti-wear additives are collectively present in the natural gas engine lubricating oil composition in an amount ranging from about 0.15 to about 1.5 wt. %, based on the total weight of the natural gas engine lubricating oil composition.

The natural gas engine lubricating oil compositions of the present invention will further include one or more oil soluble overbased alkaline earth metal-containing detergents (c); and one or more oil soluble neutral alkali metal-containing detergents (d). Detergents generally comprise a polar head with long hydrophobic tail, with the polar head comprising a metal salt of an acid organic compound. Numerous oil soluble overbased alkaline earth metal-containing detergents and oil-soluble neutral alkali metal-containing detergents are readily commercially available.

Overbased salts, or overbased materials, are single phase, homogeneous Newtonian systems characterized by a metal content in excess of that which would be present according to the stoichiometry of the metal and the particular acidic organic compound reacted with the metal. The overbased materials are prepared by reacting an acidic material (typically an inorganic acid or lower carboxylic acid such as carbon dioxide) with a mixture comprising an acidic organic compound, in a reaction medium comprising at least one inert, organic solvent (such as mineral oil, naphtha, toluene, xylene) in the presence of a stoichiometric excess of a metal base and a promoter. The overbased salts of the oil soluble alkaline earth metal-containing detergents for use herein contain an excess of metal cation and are often termed basic, hyperbased or superbased salts. In general, the terminology "metal ratio" is used herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt, the metal ratio is one and, in an overbased salt, the metal ratio is greater than one.

The one or more oil soluble overbased alkaline earth metal-containing detergent (c) employed in the natural gas engine lubricating oil composition of the present invention include, but are not limited to, sulfurized or unsulfurized alkyl or alkenyl phenates, alkyl or alkenyl aromatic sulfonates, borated sulfonates, sulfurized or unsulfurized carboxylates, sulfurized or unsulfurized metal salts of multi hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. In one embodiment, the one or more oil soluble overbased alkaline earth metal-containing detergents (c) include phenates, carboxylates, sulfonates, phosphonates, thiophosphonates and combinations thereof.

The alkaline earth metal can be any alkaline earth metal suitable for making detergents such as phenate, carboxylate, and sulfonate detergents. Non-limiting examples of suitable alkaline earth metals include calcium, barium, magnesium, or strontium and the like. In one embodiment, a suitable alkaline earth metal is calcium.

One example of suitable one or more overbased alkaline earth metal-containing detergents include basic alkaline earth metal salts of phenols (generally known as phenates) and are well known to those skilled in the art. In general, the phenols from which these phenates are formed can be represented by Formula I:

$$(R^*)_a—(Ar^*)—(OH)_m \quad (I)$$

wherein R* is an aliphatic hydrocarbon-based group of at least 4 carbon atoms, and no more than about 400 aliphatic carbon atoms, a is an integer of from one to four, Ar* is a polyvalent aromatic hydrocarbon nucleus of up to about 14 carbon atoms, and m is an integer of from one to four with the proviso that R* and a are such that there is an average of at least 8 aliphatic carbon atoms provided by the R* groups for each acid molecule represented by Formula I. Representative examples of the aromatic nuclei represented by Ar* include the polyvalent aromatic radicals derived from benzene, naphthalene, anthracene, phenanthrene, indene, fluorene, biphenyl, and the like. Generally, the group represented by Ar* will be a polyvalent nucleus derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, and the like.

The R* groups in Formula I are usually purely hydrocarbyl groups, including groups such as alkyl or alkenyl radicals. However, the R* groups may contain a small number of substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., .═O), thio groups (i.e., .═S), interrupting groups such as —NH, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include, but are not limited to, butyl, isobutyl, pentyl, octyl, nonyl, dodecyl, docosyl, tetracontyl, 5-chlorohexyl, 4-ethoxypentyl, 2-hexenyl, e-cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

A commonly available class of phenates are those made from phenols of Formula II:

(II)

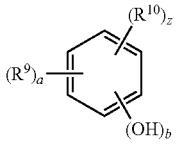

wherein a is an integer of 1-3, b is of 1 or 2, z is 0 or 1, $R^9$ is a substantially saturated hydrocarbon-based substituent having an average of from about 30 to about 400 aliphatic carbon atoms and $R^{10}$ is selected from the group consisting of lower alkyl, lower alkoxyl, nitro, and halo groups.

Another class of phenates for use herein are the basic (i.e., overbased, etc.) alkaline earth metal sulfurized phenates made by sulfurizing a phenol as described hereinabove with a sulfurizing agent such as sulfur, a sulfur halide, or sulfide or hydrosulfide salt. Techniques for making these sulfurized phenates are described in, for example, U.S. Pat. Nos. 2,680,096; 3,036,971 and 3,775,321.

Another class of phenates for use herein include those that are made from phenols that have been linked through a linking group such as an alkalene (e.g., methylene) bridge or a sulfide bridge. These are made by reacting single or multi-ring phenols with aldehydes or ketones in the presence of an acid or basic catalyst. Such linked phenates as well as sulfurized phenates are described in detail in, for example, U.S. Pat. No. 3,350,038. Examples of such linked phenates are set forth below in Formulae III-V.

(III)

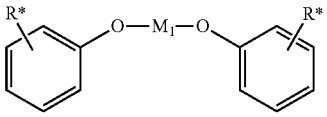

(IV)

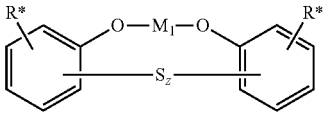

(V)

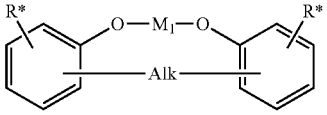

wherein each R* may be the same or different and each independently have the aforestated meanings; $M_1$ is independently an alkaline earth metal, z can range from 1 to 3 depending on the particular metal involved and Alk is a $C_1$ to $C_4$ alkalene group.

Another example of suitable one or more overbased alkaline earth metal-containing detergents include the alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkaline earth metal salt of an alkyl-substituted hydroxyaromatic carboxylic acid is derived from an alpha olefin having from about 10 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole % (e.g., at least about 80 mole %, at least about 85 mole %, at least about 90 mole %, at least about 95 mole %, or at least about 99 mole %) of the alkyl groups contained within the alkaline earth metal salt of an alkyl-substituted hydroxyaromatic carboxylic acid such as the alkyl groups of an alkaline earth metal salt of an alkyl-substituted hydroxybenzoic acid detergent are a $C_{20}$ or higher. In another embodiment, the alkaline earth metal salt of an alkyl-substituted hydroxyaromatic carboxylic acid is an alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkaline earth metal salt of an alkyl-substituted hydroxyaromatic carboxylic acid such as the alkyl groups of an alkaline earth metal salt of an alkyl-substituted hydroxybenzoic acid are about $C_{14}$ to about $C_{18}$.

The alkaline earth metals useful in making the one or more alkaline earth metal salts of an alkyl-substituted hydroxyaromatic carboxylic acid include, but are not limited to, magnesium, calcium, strontium, barium and the like. In one embodiment, the alkaline earth metal compound is calcium.

The resulting alkaline earth metal salt of an alkyl-substituted hydroxyaromatic carboxylic acid can be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

Another example of suitable one or more overbased alkaline earth metal-containing detergents include the alkaline earth metal salts of a sulfur acid. The organic sulfur acids are oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids. The sulfonic acids include the mono- or poly-nuclear aromatic or cycloaliphatic compounds. The sulfonic acids may be represented for the most part by one of the following Formulae VI or VII:

$$R^1(SO_3H)_r \quad (VI)$$

$$(R^2)_xT(SO_3H)_y \quad (VII)$$

wherein T is an aromatic nucleus such as, for example, benzene, toluene, xylene, naphthalene, biphenyl, anthracene, phenanthrene, diphenylene oxide, thianthrene, phenothioxine, diphenylene sulfide, phenothiazine, diphenyl oxide, diphenyl sulfide, diphenylamine, and the like; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater. Specific examples of $R^1$ include groups derived from petrolatum, saturated and unsaturated paraffin wax, and polyolefins, including polymerized $C_2$-$C_6$ olefins containing from about 15 to about 7000 or more carbon atoms. The groups T, $R^1$ and $R^2$ in the above formulae can also contain other inorganic or organic substituents in addition to those enumerated above, e.g., hydroxy, mercapto, halogen, nitro, amino, nitroso, sulfide, disulfide, etc. The subscript x is generally 1 to 3, and the subscripts r and y generally have an average value of about 1 to 4 per molecule.

One class of examples of the oil-soluble sulfonic acids of Formulae VI and VII, include mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkylbenzene sulfonic acids (where the alkyl group has at least 8 carbons), cetylphenol mono-sulfide sulfonic acids, dicetyl thianthrenedisulfonic acids, dilauryl-betanaphthylsulfonic acids, and alkaryl sulfonic acids such as dodecylbenzene "bottoms" sulfonic acids. It is to be understood that for every sulfonic acid enumerated, it is intended that the corresponding basic metal salts thereof are also understood to be illustrated.

The alkaryl sulfonic acids are acids derived from, for example, benzene, toluene, xylene and the like, which has been alkylated with propylene tetramers or isobutene trimers to introduce 1, 2, 3, or more branched-chain $C_{12}$ substituents on the ring. Dodecylbenzene bottoms, principally mixtures of mono- and di-dodecylbenzenes, are available as by-products from the manufacture of household detergents. Similar products obtained from alkylation bottoms formed during manufacture of linear alkylsulfonates (LAS) are also useful in making the alkaline earth metal-containing sulfonate detergents used in this invention.

The production of sulfonates from detergent manufacture byproducts is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic sulfonate salts and methods for making them can be found in, for example, U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 3,595,790; and 3,798,012. Also included are aliphatic sulfonic acids such as paraffin wax sulfonic acids, unsaturated paraffin wax sulfonic acids, hydroxy-substituted paraffin wax sulfonic acids, hexapropylenesulfonic acids, tetra-amylene sulfonic acids, polyisobutenesulfonic acids wherein the polyisobutene contains from about 20 to about 7000 or more carbon atoms, chloro-substituted paraffin wax sulfonic acids, nitro-paraffin wax sulfonic acids, etc; cycloaliphatic sulfonic acids such as petroleum naphthenesulfonic acids, cetylcyclopentyl sulfonic acids, laurylcyclohexylsulfonic acids, bis(di-isobutyl)cyclohexyl sulfonic acids, mono- or poly-wax substituted cyclohexylsulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

If desired, the overbased detergent disclosed herein may also be borated.

The overbased alkaline earth metal-containing detergents for use in the natural gas engine lubricating oil compositions of the present invention may be low overbased, e.g., an overbased salt having a BN below about 50. In one embodiment, the BN of a low overbased salt may be from about 5 to about 50. In another embodiment, the BN of a low overbased salt may be from about 10 to about 30. In yet another embodiment, the BN of a low overbased salt may be from about 15 to about 20.

The overbased alkaline earth metal-containing detergents for use in the natural gas engine lubricating oil compositions of the present invention may be medium overbased, e.g., an overbased salt having a BN from greater than 50 to about 200. In one embodiment, the BN of a medium overbased salt may be from greater than 50 to about 180. In one embodiment, the BN of a medium overbased salt may be from about 100 to about 200. In another embodiment, the BN of a medium overbased salt may be from about 110 to about 175.

The overbased alkaline earth metal-containing detergents for use in the natural gas engine lubricating oil compositions of the present invention may be high overbased, e.g., an overbased salt having a BN above 200. In one embodiment, the BN of a high overbased salt may be from about 250 to about 450.

The natural gas engine lubricating oil compositions according to the present invention may contain more than one of the foregoing overbased alkaline earth metal-containing detergents, which may be all low BN salts, all medium BN salts, all high BN salts as well as mixtures thereof.

Generally, the one or more overbased alkaline earth metal-containing detergents are present in the natural gas engine lubricating oil composition in an amount ranging from about 0.5 to about 5.0 wt. %, based on the total weight of the natural gas engine lubricating oil composition. In another embodiment, the one or more overbased alkaline earth metal-containing detergents are present in the natural gas engine lubricating oil composition in an amount ranging from about 0.5 to about 1.5 wt. %, based on the total weight of the natural gas engine lubricating oil composition.

The one or more oil soluble neutral alkali metal-containing detergents (d) employed in the natural gas engine lubricating oil composition of the present invention include, but are not limited to, sulfurized or unsulfurized alkyl or alkenyl phenates, alkyl or alkenyl aromatic sulfonates, borated sulfonates, sulfurized or unsulfurized carboxylates, sulfurized or unsulfurized metal salts of multi hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. In one embodiment, one or more oil soluble neutral alkali metal-containing detergents (d) include phenates, carboxylates, sulfonates, phosphonates, thiophosphonates and combinations thereof.

The alkali metal can be any alkali metal suitable for making detergents such as phenate, carboxylate, and sulfonate detergents. Non-limiting examples of suitable alkali metals include lithium, sodium, potassium, rubidium, and cesium. In one embodiment, a suitable alkali metal includes sodium and potassium. In another embodiment, a suitable alkali metal is sodium.

The neutral salts of the oil soluble alkali metal-containing detergents for use herein contain an amount of metal cation just sufficient to neutralize the acidic groups present in the salt anion; whereas the overbased salts contain an excess of metal cation and are often termed basic, hyperbased or superbased salts. In a normal or neutral salt, the metal ratio is one and, in an overbased salt, the metal ratio is greater than one.

Examples of the neutral salts of the oil soluble alkali metal-containing detergents for use herein can be any of the phenates, carboxylates and sulfonates described above with respect to the one or more oil soluble overbased alkaline earth metal-containing detergents (c).

Generally, the one or more neutral alkali metal-containing detergents are present in the natural gas engine lubricating oil composition in an amount ranging from about 0.5 wt. % to about 5.0 wt. %, based on the total weight of the natural gas engine lubricating oil composition. In one embodiment, the one or more neutral alkali metal-containing detergents are present in the natural gas engine lubricating oil composition in an amount ranging from about 0.5 wt. % to about 2.0 wt. %, based on the total weight of the lubricating oil composition.

In one embodiment, the one or more oil soluble neutral alkali metal-containing detergents are present in an amount sufficient to contribute at least about 30% of the total sulfated ash of the composition.

The natural gas engine lubricating oil compositions may also contain other conventional additives for imparting auxiliary functions to give a finished natural gas engine lubricating oil composition in which these additives are dispersed or dissolved. For example, the natural gas engine lubricating oil compositions may be blended with ashless dispersants, antioxidants, rust inhibitors, dehazing agents, demulsifying agents, metal deactivating agents, friction modifiers, pour point depressants, antifoaming agents, co-solvents, package compatibilisers, corrosion-inhibitors, dyes, extreme pressure agents and the like and mixtures thereof. A variety of the additives are known and commercially available. These additives, or their analogous compounds, can be employed for the preparation of the natural gas engine lubricating oil compositions of the invention by the usual blending procedures.

The ashless dispersant compounds employed in the natural gas engine lubricating oil composition of the present invention are generally used to maintain in suspension insoluble materials resulting from oxidation during use, thus preventing sludge flocculation and precipitation or deposition on metal parts. Dispersants may also function to reduce changes in lubricating oil viscosity by preventing the growth of large contaminant particles in a lubricating oil. The dispersant employed in the present invention may be any suitable ashless dispersant or mixture of multiple ashless dispersants for use in a natural gas engine lubricating oil composition. An ashless dispersant generally comprises an oil soluble polymeric hydrocarbon backbone having functional groups that are capable of associating with particles to be dispersed.

In one embodiment, an ashless dispersant is one or more basic nitrogen-containing ashless dispersants. Nitrogen-containing basic ashless (metal-free) dispersants contribute to the base number or BN (as can be measured by ASTM D 2896) of a lubricating oil composition to which they are added, without introducing additional sulfated ash. Basic nitrogen-containing ashless dispersants useful in this invention include hydrocarbyl succinimides; hydrocarbyl succinamides; mixed ester/amides of hydrocarbyl-substituted succinic acids formed by reacting a hydrocarbyl-substituted succinic acylating agent stepwise or with a mixture of alcohols and amines, and/or with amino alcohols; Mannich condensation products of hydrocarbyl-substituted phenols, formaldehyde and polyamines; and amine dispersants formed by reacting high molecular weight aliphatic or alicyclic halides with amines, such as polyalkylene polyamines. Mixtures of such dispersants can also be used.

Representative examples of ashless dispersants include, but are not limited to, amines, alcohols, amides, or ester polar moieties attached to the polymer backbones via bridging groups. An ashless dispersant of the present invention may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Carboxylic dispersants are reaction products of carboxylic acylating agents (acids, anhydrides, esters, etc.) comprising at least about 34 and preferably at least about 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters.

Succinimide dispersants are a type of carboxylic dispersant. They are produced by reacting hydrocarbyl-substituted succinic acylating agent with organic hydroxy compounds, or with amines comprising at least one hydrogen atom attached to a nitrogen atom, or with a mixture of the hydroxy compounds and amines. The term "succinic acylating agent" refers to a hydrocarbon-substituted succinic acid or a succinic acid-producing compound, the latter encompasses the acid itself. Such materials typically include hydrocarbyl-substituted succinic acids, anhydrides, esters (including half esters) and halides.

Succinic-based dispersants have a wide variety of chemical structures. One class of succinic-based dispersants may be represented by the formula:

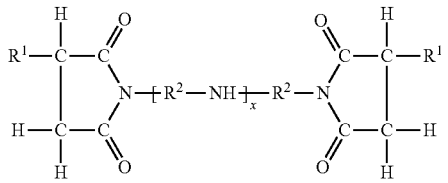

wherein each $R^1$ is independently a hydrocarbyl group, such as a polyolefin-derived group. Typically the hydrocarbyl group is an alkyl group, such as a polyisobutyl group. Alternatively expressed, the $R^1$ groups can contain about 40 to about 500 carbon atoms, and these atoms may be present in aliphatic forms. $R^2$ is an alkylene group, commonly an ethylene ($C_2H_4$) group. Examples of succinimide dispersants include those described in, for example, U.S. Pat. Nos. 3,172,892, 4,234,435 and 6,165,235.

The polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

Succinimide dispersants are referred to as such since they normally contain nitrogen largely in the form of imide functionality, although the amide functionality may be in the form of amine salts, amides, imidazolines as well as mixtures thereof. To prepare a succinimide dispersant, one or more succinic acid-producing compounds and one or more amines are heated and typically water is removed, optionally in the presence of a substantially inert organic liquid solvent/diluent. The reaction temperature can range from about 80° C. up to the decomposition temperature of the mixture or the product, which typically falls between about 100° C. to about 300° C. Additional details and examples of procedures for preparing the succinimide dispersants of the present invention include those described in, for example, U.S. Pat. Nos. 3,172,892, 3,219,666, 3,272,746, 4,234,435, 6,165,235 and 6,440,905.

Suitable ashless dispersants may also include amine dispersants, which are reaction products of relatively high molecular weight aliphatic halides and amines, preferably polyalkylene polyamines. Examples of such amine dispersants include those described in, for example, U.S. Pat. Nos. 3,275,554, 3,438,757, 3,454,555 and 3,565,804.

Suitable ashless dispersants may further include "Mannich dispersants," which are reaction products of alkyl phenols in which the alkyl group contains at least about 30 carbon atoms with aldehydes (especially formaldehyde) and amines (especially polyalkylene polyamines). Examples of such dispersants include those described in, for example, U.S. Pat. Nos. 3,036,003, 3,586,629, 3,591,598 and 3,980,569.

Suitable ashless dispersants may also be post-treated ashless dispersants such as post-treated succinimides, e.g., post-treatment processes involving borate or ethylene carbonate as disclosed in, for example, U.S. Pat. Nos. 4,612,132 and 4,746,446; and the like as well as other post-treatment processes. The carbonate-treated alkenyl succinimide is a polybutene succinimide derived from polybutenes having a molecular weight of about 450 to about 3000, preferably from about 900 to about 2500, more preferably from about 1300 to about 2400, and most preferably from about 2000 to about 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as disclosed in U.S. Pat. No. 5,716,912, the contents of which are incorporated herein by reference.

Suitable ashless dispersants may also be polymeric, which are interpolymers of oil-solubilizing monomers such as decyl methacrylate, vinyl decyl ether and high molecular weight olefins with monomers containing polar substitutes. Examples of polymeric dispersants include those described in, for example, U.S. Pat. Nos. 3,329,658; 3,449,250 and 3,666,730.

In one preferred embodiment of the present invention, an ashless dispersant for use in the lubricating oil composition is a bis-succinimide derived from a polyisobutenyl group having a number average molecular weight of about 700 to about 2300. The dispersant(s) for use in the lubricating oil compositions of the present invention are preferably non-polymeric (e.g., are mono- or bis-succinimides).

Generally, the one or more ashless dispersants are present in the natural gas engine lubricating oil composition in an amount ranging from about 1 to about 8 wt. %, based on the total weight of the natural gas engine lubricating oil composition. In one embodiment, the one or more ashless dispersants are present in the natural gas engine lubricating oil composition in an amount ranging from about 1.5 to about 6 wt. %, based on the total weight of the natural gas engine lubricating oil composition.

The one or more antioxidant compounds employed in the natural gas engine lubricating oil composition of the present invention reduce the tendency of base stocks to deteriorate in service, which deterioration can be evidenced by the products of oxidation such as sludge and varnish-like deposits on the metal surfaces and by viscosity growth. Such oxidation inhibitors include hindered phenols, ashless oil soluble phenates and sulfurized phenates, diphenylamines, alkyl-substituted phenyl and naphthylamines and the like and mixtures thereof. Diphenyamine-type oxidation inhibitors include, but are not limited to, alkylated diphenylamine, phenyl-α-naphthylamine, and alkylated-α-naphthylmine.

In one embodiment, an antioxidant compound for use herein can be one or more hindered phenols having the general formula:

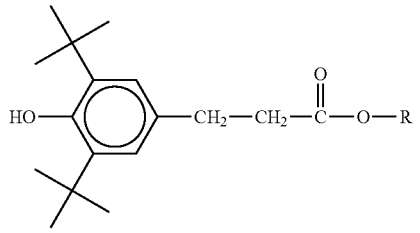

wherein R is a $C_1$ to $C_{30}$ hydrocarbyl group including by way of example, a substituted or unsubstituted alkyl group, substituted or unsubstituted cycloalkyl group, substituted or unsubstituted aryl group, substituted or unsubstituted heterocyclic group and the like. A representative example of a hindered phenol is 3,5-di-t-butyl 4-hydroxy phenol propionate. The hindered phenol, 3,5-di-t-butyl 4-hydroxy phenol propionate may be available commercially from, for example, Ciba Specialty Chemicals (Terrytown, N.Y.) as IRGANOX L135®, Crompton Corporation (Middlebury, Conn.) as Naugard® PS-48. In one embodiment, a hindered phenol is a liquid hindered phenol.

Generally, the one or more antioxidant compounds are present in the natural gas engine lubricating oil composition in an amount ranging from about 0.1 to about 5 wt. %, based on the total weight of the natural gas engine lubricating oil composition. In one embodiment, the one or more antioxidant compounds are present in the natural gas engine lubricating oil composition in an amount ranging from about 0.2 to about 4 wt. %, based on the total weight of the natural gas engine lubricating oil composition.

Examples of rust inhibitors include, but are not limited to, nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

Examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, preferably a $C_6$ to $C_{24}$, and most preferably a $C_6$ to $C_{20}$, fatty acid ester and a nitrogen-containing compound selected from the group consisting of ammonia, and an alkanolamine and the like and mixtures thereof.

Examples of antifoaming agents include, but are not limited to, polymers of alkyl methacrylate; polymers of dimethylsilicone and the like and mixtures thereof.

Examples of a pour point depressant include, but are not limited to, polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In one embodiment, a pour point depressant comprises an ethylene-vinyl acetate copolymer, a condensate of chlorinated paraffin and phenol, polyalkyl styrene and the like and combinations thereof. The amount of the pour point depressant may vary from about 0.01 wt. % to about 10 wt. %.

Examples of a demulsifier include, but are not limited to, anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and the like and combinations thereof. The amount of the demulsifier may vary from about 0.01 wt. % to about 10 wt. %.

Examples of a corrosion inhibitor include, but are not limited to, half esters or amides of dodecylsuccinic acid, phosphate esters, thiophosphates, alkyl imidazolines, sarcosines and the like and combinations thereof. The amount of the corrosion inhibitor may vary from about 0.01 wt. % to about 0.5 wt. %.

Examples of an extreme pressure agent include, but are not limited to, sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof. The amount of the extreme pressure agent may vary from about 0.01 wt. % to about 5 wt. %.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant. Generally, the concentration of each of these additives, when used, ranges from about 0.001% to about 20% by weight, and in one embodiment about 0.01% to about 10% by weight based on the total weight of the natural gas engine lubricating oil composition.

If desired, the lubricating oil additives may be provided as an additive package or concentrate in which the additives are incorporated into a substantially inert, normally liquid organic diluent such as, for example, mineral oil, naphtha, benzene, toluene or xylene to form an additive concentrate. These concentrates usually contain from about 20% to about 80% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used. The additive package will typically contain the additives, referred to above, in the desired amounts and ratios to facilitate direct combination with the requisite amount of base oil.

The natural gas engine lubricating oil compositions of the present invention can be conveniently prepared by simply blending or mixing the additives with the oil of lubricating viscosity. The additives may also be preblended as a concentrate, as discussed hereinabove, in the appropriate ratios to facilitate blending of a natural gas engine lubricating composition containing the desired concentration of additives. The additive package is blended with the base oil using a concentration at which they are both soluble in the oil and compatible with other additives in the desired finished lubricating oil. Compatibility in this instance generally means that the present compounds as well as being oil soluble in the applicable treat rate also do not cause other additives to precipitate under normal conditions. Suitable oil solubility/compatibility ranges for a given compound of lubricating oil formulation can be determined by those having ordinary skill in the art using routine solubility testing procedures. For example, precipitation from a formulated lubricating oil composition at ambient conditions (about 20° C. to 25° C.) can be measured by either actual precipitation from the oil composition or the formulation of a "cloudy" solution which evidences formation of insoluble wax particles.

In one embodiment, the natural gas engine lubricating oil compositions described herein can be substantially free of any alkaline earth metal salts of a condensation product of an alkylene polyamine, an aldehyde and a substituted phenol. In one embodiment, the lubricating oil compositions are also substantially free of any molybdenum-containing compounds. The alkylene polyamines of the condensation product can the following structure $NH_2[R(R)—NH]_nH$ wherein R is an alkylene radical containing from about 2 about 6 carbon atoms, and n is an integer from 1 to about 10. Typical alkylene polyamines include diethylenetriamine, triethylenetetramine, tetraethylenepentamine and the like. The aldehydes are generally aliphatic aldehydes which contain from one to about 3 carbon atoms per molecule. The substituted phenols are the alkylated monohydric phenols having at least one alkyl group of sufficient length to impart oil-solubility to the condensation products. Representative alkyl phenols are those in which the alkyl group contains from about 4 to about 24 carbon atoms, and preferably those having from about 8 to about 24 carbon atoms, such as, for example, n-amyl phenol, diamylphenol, octyl phenol, nonyl phenol, p-ter-octyl phenol, a mixture of phenols, wax alkylated phenols and the like.

In one embodiment, the natural gas engine lubricating oil compositions of the present invention will contain sulfurized isobutylene. Sulfurized isobutylene is known by those skilled in the art to be an extreme pressure agent, effective in preventing wear in high pressure environments such as gear lubrication. Sulfurized isobutylene comprises a long chain hydrocarbon that is reacted with a various sulfur compounds that are incorporated into the chain. This provides an oil soluble compound that is effective in providing extreme pressure (EP) protection. Sulfurized isobutylene for use in certain embodiments of this invention may include one or more of sulfurized isobutylenes such as Mobilad C-100 and R. T. Vanderbilt Vanlube SB.

Generally, the natural gas engine lubricating oil compositions of this invention will contain from about 0.01 wt. % to about 0.5 wt. % sulfurized isobutylene. In another embodiment, the natural gas engine lubricating oil compositions of this invention will contain from about 0.02 wt. % to about 0.45 wt. % sulfurized isobutylene.

The following non-limiting examples are illustrative of the present invention.

EXAMPLE 1

A natural gas engine lubricating oil composition was formed containing 1.135 wt. % of a bis-succinimide (derived from a 1300 MW polyisobutenyl succinic anhydride (PIBSA)) and a mixture of heavy polyamine and diethylenetriamine, 1.865 wt. % of a bis-succinimide (derived from a 950 MW polyisobutenyl succinic anhydride (PIBSA)) and a mixture of heavy polyamine and diethylenetriamine, 0.85 wt. % of an overbased sulfurized calcium phenate (114 BN), 1.07 wt. % of a neutral sodium sulfonate; 1.25 wt. % of a hindered phenol antioxidant, 0.14 wt. % of a sulfurized isobutylene, 0.05 copper deactivator, 0.19 wt. % of a primary zinc alkyl dithiophosphate, 5 ppm of foam inhibitor and the balance being a Group II base oil.

The natural gas engine lubricating oil composition had a sulfated ash content of 0.26 wt. % as determined by ASTM D 874 and a phosphorus content of 0.014 wt. %.

COMPARATIVE EXAMPLE A

A natural gas engine lubricating oil composition was formed containing 1.135 wt. % of a bis-succinimide (derived from a 1300 MW polyisobutenyl succinic anhydride (PIBSA)) and a mixture of heavy polyamine and diethylenetriamine, 1.865 wt. % of a bis-succinimide (derived from a 950 MW polyisobutenyl succinic anhydride (PIBSA)) and a mixture of heavy polyamine and diethylenetriamine, 2.76 wt. % of a neutral sodium sulfonate; 1.25 wt. % of a hindered phenol antioxidant, 0.14 wt. % of a sulfurized isobutylene, 0.05 copper deactivator, 0.18 wt. % of a primary zinc alkyl dithiophosphate, 5 ppm of foam inhibitor and the balance being a Group II base oil.

The natural gas engine lubricating oil composition had a sulfated ash content of 0.26 wt. % as determined by ASTM D 874 and a phosphorus content of 0.014 wt. %.

COMPARATIVE EXAMPLE B

A natural gas engine lubricating oil composition was formed containing 1.135 wt. % of a bis-succinimide (derived from a 1300 MW polyisobutenyl succinic anhydride (PIBSA)) and a mixture of heavy polyamine and diethylenetriamine, 1.865 wt. % of a bis-succinimide (derived from a 950 MW polyisobutenyl succinic anhydride (PIBSA)) and a mixture of heavy polyamine and diethylenetriamine, 1.50 wt. % of an overbased sulfurized calcium phenate (114 BN), 1.25 wt. % of a hindered phenol antioxidant, 0.14 wt. % of a sulfurized isobutylene, 0.05 copper deactivator, 0.18 wt. % of a primary zinc alkyl dithiophosphate, 5 ppm of foam inhibitor and the balance being a Group II base oil.

The natural gas engine lubricating oil composition had a sulfated ash content of 0.26 wt. % as determined by ASTM D 874 and a phosphorus content of 0.014 wt. %.

Testing

A 6-cylinder Waukesha F11 GSID engine was instrumented in order to obtain dynamic voltage measurements from 12 valves—6 intake and 6 exhaust valves. The tests were run for 400 hours on the natural gas engine lubricating oil compositions of Example 1 and Comparative Examples A and B and the average valve recession wear rates of an oil were calculated by a linear fit based on the last 300-hours of data from each test and reported on a wear rate per 1000 hours. The maximum valve recession wear rate allowed by the original equipment manufacturer (OEM) is 0.0020 inches/1000 hours. As shown in FIG. 1, the natural gas engine lubricating oil composition of Example 1 containing an overbased sulfurized calcium phenate detergent and neutral sodium sulfonate showed optimal valve recession (0.00011 inches) over the natural gas engine lubricating oil composition of Comparative Example A containing a neutral sodium sulfonate detergent (−0.00152 inches) and significantly improved valve recession over the natural gas engine lubricating oil composition of Comparative Example B containing an overbased sulfurized calcium phenate detergent (0.00065 inches).

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A natural gas engine lubricating oil composition comprising (a) a major amount of an oil of lubricating viscosity, (b) about 0.15 to about 1.5 wt. % of one or more phosphorus-containing anti-wear additives, wherein the one or more phosphorus-containing anti-wear additives comprises a zinc alkyldithiophosphate: (c) about 0.5 wt. % to about 1.5 wt. % of one or more oil soluble overbased alkaline earth metal-containing detergents comprising an oil soluble overbased calcium or magnesium phenate wherein the one or more oil soluble overbased alkaline earth metal-containing detergents have a base number (BN) of from greater than 50 to about 200; and (d) about 0.5 wt. % to about 2.0 wt. % of one or more oil soluble neutral alkali metal-containing detergents comprising an oil soluble neutral sodium or potassium sulfonate, wherein the natural gas engine lubricating oil composition contains no more than about 0.03 weight percent of phosphorus, based on the total weight of the natural gas engine lubricating oil composition; and wherein said lubricating oil composition has a sulfated ash content of no more than about 1 wt. % as determined by ASTM D 874.

2. The natural gas engine lubricating oil composition of claim 1, wherein the one or more phosphorus-containing anti-wear additives are selected from the group consisting of a hydrocarbyl phosphite, a hydrocarbyl phosphate and mixtures thereof.

3. The natural gas engine lubricating oil composition of claim 1, wherein the one or more oil soluble overbased alkaline earth metal-containing detergents have a base number (BN) of from greater than 50 to about 200.

4. The natural gas engine lubricating oil composition of claim 1, wherein the one or more oil soluble overbased alkaline earth metal-containing detergents have a BN of from about 250 to about 450.

5. The natural gas engine lubricating oil composition of claim 1, wherein the one or more oil soluble overbased alkaline earth metal-containing detergents comprise a calcium phenate and the or more oil soluble neutral alkali metal-containing detergents comprise a sodium sulfonate.

6. The natural gas engine lubricating oil composition of claim 1, wherein the natural gas engine lubricating oil composition further comprises one or more natural gas engine lubricating oil composition additives selected from the group consisting of an ashless dispersant, antioxidant, rust inhibitor, dehazing agent, demulsifying agent, metal deactivating agent, friction modifier, pour point depressant, antifoaming agent, co-solvent, package compatibiliser, corrosion-inhibitor, dye, extreme pressure agent and mixtures thereof.

7. The natural gas engine lubricating oil composition of claim 1, wherein the one or more ashless dispersants comprises a bissuccinimide.

8. The natural gas engine lubricating oil composition of claim 1, having a sulfated ash content of about 0.15 to about 0.3 wt. % as determined by ASTM D 874.

9. The natural gas engine lubricating oil composition of claim 1, further comprising sulfurized isobutylene.

10. A method for preventing or inhibiting exhaust valve seat recession in a natural gas fueled engine, the method comprising lubricating the natural gas fueled engine with a natural gas engine lubricating oil composition comprising (a) a major amount of an oil of lubricating viscosity; (b) about 0.15 to about 1.5 wt. % of one or more phosphorus-containing anti-wear additives, wherein the one or more phosphorus-containing anti-wear additives comprises a zinc alkyldithiophosphate; (c) about 0.5 wt. % to about 1.5 wt. % of one or more oil soluble overbased alkaline earth metal-containing detergents comprising an oil soluble overbased calcium or magnesium phenate wherein the one or more oil soluble overbased alkaline earth metal-containing detergents have a base number (BN) of from greater than 50 to about 200; and (d) about 0.5 wt. % to about 2.0 wt, % of one or more oil soluble neutral alkali metal-containing detergents comprising an soluble neutral sodium or potassium sulfonate, wherein the natural gas engine lubricating oil composition contains no more than about 0.03 weight percent of phosphorus, based on the total weight of the natural gas engine lubricating oil composition; and wherein said lubricating oil composition has a sulfated ash content of no more than about 1 wt. % as determined by ASTM D 874.

11. The method of claim 10, wherein the one or more phosphorus-containing anti-wear additives are selected from the group consisting, of a hydrocarbyl phosphite, a hydrocarbyl phosphate and mixtures thereof.

12. The method of claim 10, wherein the one or more oil soluble overbased alkaline earth metal-containing detergents comprise a calcium phonate and the one or more oil soluble neutral alkali metal-containing detergents comprise a sodium sulfonate.

13. The method of claim 10, wherein the natural gas engine lubricating oil composition further comprises one or more natural gas engine lubricating oil composition additives selected from the group consisting of an ashless dispersant, antioxidant, rust inhibitor, dehazing agent, demulsifying agent, metal deactivating agent, friction modifier, pour point depressant, antifoaming agent, co-solvent, package compatibiliser, corrosion-inhibitor, dye, extreme pressure agent and mixtures thereof.

14. The method of claim 10, wherein the natural gas engine lubricating oil composition has a sulfated ash content of about 0.15 to about 0.3 wt. % as determined by ASTM D 874.

15. The natural gas engine lubricating oil composition of claim 1, wherein the one or more oil soluble overbased alkaline earth metal-containing detergents and the on or more oil soluble neutral alkali metal-containing detergents are the only detergents in the natural gas engine lubricating oil composition.

16. The method of claim 10, wherein the one or more oil soluble overbased alkaline earth metal-containing detergents and the one or more oil soluble neutral alkali metal-containing detergents are the only detergents in the natural gas engine lubricating oil composition.

* * * * *